United States Patent [19]

Mathieu

[11] 4,338,583

[45] Jul. 6, 1982

[54] MANUAL/MAGNETIC MOTOR CONTACTOR

[75] Inventor: Raymond J. Mathieu, Ludlow Falls, Ohio

[73] Assignee: Hobart Corporation, Troy, Ohio

[21] Appl. No.: 206,500

[22] Filed: Nov. 13, 1980

[51] Int. Cl.[3] ..... H01H 45/00

[52] U.S. Cl. ..... 335/186; 335/164; 335/165

[58] Field of Search ..... 335/186, 164, 165, 72, 335/126, 140, 238, 131

[56] References Cited

U.S. PATENT DOCUMENTS

| | | | |
|---|---|---|---|
| 3,622,925 | 11/1971 | Rose | 335/186 |
| 3,842,375 | 10/1974 | Collette | 335/164 |
| 3,925,742 | 12/1975 | Muench | 335/164 |
| 4,246,559 | 1/1981 | Budrose | 335/186 |

*Primary Examiner*—Harold Broome

*Attorney, Agent, or Firm*—Biebel, French & Nauman

[57] ABSTRACT

A switch for controlling an electric circuit has a sealed housing and a slidable actuator mounted therein for external manual operation of the switch through a diaphragm. A switch mechanism, mounted within the housing, has an electromagnet, a plurality of pairs of contacts for controlling external electric circuits, a pair of control contacts for controlling the power to the electromagnet, and an armature movable in response to energizing and deenergizing of the electromagnet. When the actuator is pulled outwardly, a projection thereon closes the control pair of contacts, energizing the electromagnet, and causing the armature to close the remaining pairs of contacts and hold closed the control pair. Pushing the actuator inwardly opens the control contact pair, which deenergizes the electromagnet and thereby opens the other pairs of contacts. If any contact pair tacks together upon deactivation of the switch, movement of the actuator will cause a corresponding additional projection to engage and separate the tacked pair. After movement of the actuator in either direction, it returns to a center position.

16 Claims, 14 Drawing Figures

MANUAL/MAGNETIC MOTOR CONTACTOR

BACKGROUND OF THE INVENTION

1. Field of Invention

The present invention relates to switches for controlling electric circuits, and, more particularly, for controlling circuits in which high current is present. Moreover, the switch of the present invention is activated by pulling on an actuator, and deactivated by pushing the same.

2. Description of the Prior Art

One general type of switch used for controlling electric circuits includes an electromagnet. When energized, the electromagnet moves an armature that in turn closes or opens one or more electrical contacts. The energized electromagnet then holds the armature in such a position that the contacts remain closed or open. When the electromagnet is deenergized, the armature, and in turn the contacts, return to their initial positions.

This type of switch is particularly useful in circuits in which high current is present. Whenever the contacts in any type of switch in a high-current circuit are closed or opened, arcing results as the contact members approach or move away from each other. This arcing can lead to the contacts becoming welded together. It also causes erosion of the contact material and greatly shortens contact life. In some switches where the contacts are manually closed or opened, the operator is apt to close or open them slowly. This results in a long period for arcing and high probability of contact erosion or of welding the contacts. In a switch where the contacts are closed or opened by an electromagnet, however, the contacts move quickly. The length of time during which arcing can occur is greatly reduced, and the contact erosion and the possibility of welding the contacts is therefore significantly lowered.

The standard relay is an example of the type of switch discussed above. In a relay, the electromagnet is energized and deenergized by an electrical control means remote from the relay. While useful in high-current circuits, in some applications a relay has several disadvantages. The remote energizing control increases the bulk and complexity of the switching device. Additionally, in situations where it is necessary to keep the switch air and watertight, a remote energizing control and the associated wiring conduits and connection points significantly increase the opportunities for leakage. Moreover, in the event of "tacking," or sticking, of the contacts upon attempting to open them, the operator has no real means for freeing the contacts and controlling the circuit short of disassembling the switch.

U.S. Pat. No. 3,622,925 discloses another example of a switch of this general type. A switch is shown wherein a push-button type actuator is used to close a pair of normally-open contacts and thereby energize an electromagnet. The electromagnet moves an armature that engages the same contacts, holding them closed. Although the switch reduces the bulk and leakage potential of the relay, it is a starting switch only. A circuit activated by the switch cannot be deactivated by the same switch. Further, since the contacts held closed by the actuator are initially closed manually, such a switch will not reduce the possibility for welding of the contacts in high current applications. Moreover, the switch provides no means for separating the contacts in the event of "tacking."

U.S. Pat. No. 3,848,205 discloses yet another example of the general type of switch. A switch for controlling an electric motor is shown wherein an electromagnet is connected across a pair of normally-closed contacts. An actuator and a projection are mounted to an armature. Upon movement of the actuator, the armature, and in turn the projection, are moved so that the projection engages and opens the contacts. The electromagnet is then energized and holds the armature causing the projection to hold the contacts open. By energizing the electromagnet, current through the motor is reduced such that the motor will stop. While this switch also reduces the bulk and leakage potential of the relay, it cannot restart the stopped motor. Moreover, such a switch does not completely deactivate the circuit.

SUMMARY OF THE INVENTION

The switch of the present invention incorporates the advantage of the standard relay for high-current applications in that the possibility of welding the contacts together is quite low. In contrast to the standard relay, however, the switch of the present invention is compact and self-contained. Thus, assembly and installation are facilitated, and the switch is particularly well-suited for use in a hostile environment. Further, unlike the prior art, the switch provides means for separating the contacts in the event that "tacking" occurs.

Accordingly, the present invention provides a switch for controlling an electric circuit, the switch having an electromagnet, a plurality of pairs of contacts, and an armature. One pair of contacts is connected in series with the electromagnet so as to energize and deenergize the same. A manually-operated actuator is provided, with a control projection mounted thereon and disposed between the first pair of contacts and the armature. Additional projections are mounted to the actuator, one each being disposed adjacent one pair of contacts opposite the armature. A housing is provided enclosing the aforementioned parts such that the switch is therefore air and watertight.

In activating the switch, the operator pulls a knob or handle attached to the actuator. The pulling motion moves the actuator and the control projection, which pushes against and closes the first pair of contacts, energizing the electromagnet. The electromagnet moves the armature, which in turn closes the remaining contacts, thereby holding all pairs of contacts closed.

To deactivate the switch, the operator pushes on the knob or handle, moving the actuator and the control projection in the opposite direction. The projection pushes against and moves a flexible portion of the armature. This releases the first pair of contacts, allowing them to open and deenergize the electromagnet. The armature is then released, and the remaining contacts are allowed to open.

It should be understood that the first pair of contacts that are manually closed carry a current to energize the electromagnet that is only a small fraction of the load current carried by the remaining contacts. Thus the arcing at the manually-actuated first contact pair is minimal, with the result that there is no real problem of erosion or of tacking together of this contact pair. Arcing at the remaining load contacts is minimized by the consistent, rapid actuation of the load contacts by the electromagnet and its armature. In the event that "tacking" of any of the pairs of contacts has occurred upon initiating de-activation of the switch, when the operator pushes on the knob or handle, movement of the actuator causes the additional projections to engage and push against the pairs of contacts. Any pairs which have "tacked" together are thereby separated.

Further benefits of the present invention arise from a straight line pull-to-start and push-to-stop configuration of the switch. By use of a pulling motion to activate the switch, the possibility for accidental activation is greatly reduced. By use of a pushing motion to deactivate the switch, emergency deactivation of the switch is facilitated. Also, because the switch utilizes an electromagnet for activation, in the event of loss of electrical power or significant reduction in voltage thereof, the switch will deactivate automatically. Moreover, the switch and devices controlled thereby will not automatically restart when full power is restored, since manual activation will then be required.

Additional advantages and benefits provided by the present invention will become apparent to those skilled in the art upon a reading of the following detailed description and figures associated therewith.

DESCRIPTION OF THE PREFERRED EMBODIMENT

The Housing and the Actuator

Figure 1:
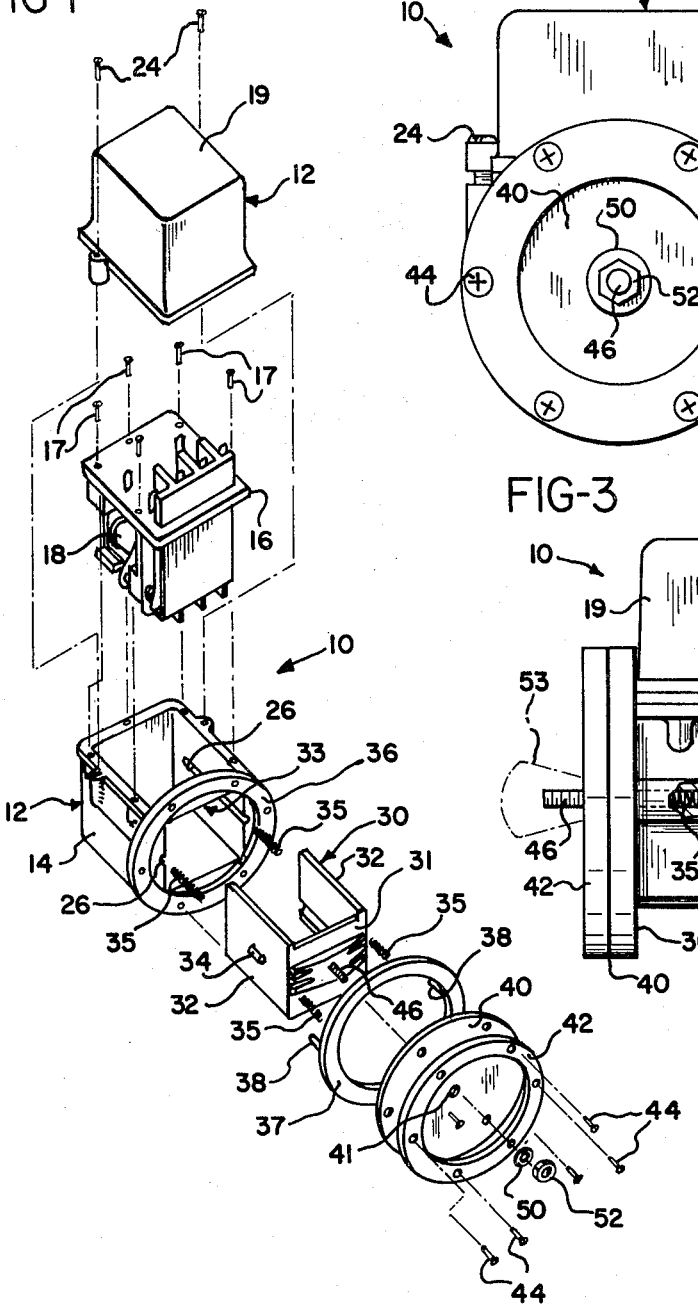
FIG. 1 is an exploded perspective view of the switch of the present invention, showing particularly the housing and actuator assemblies.
Figure 2:
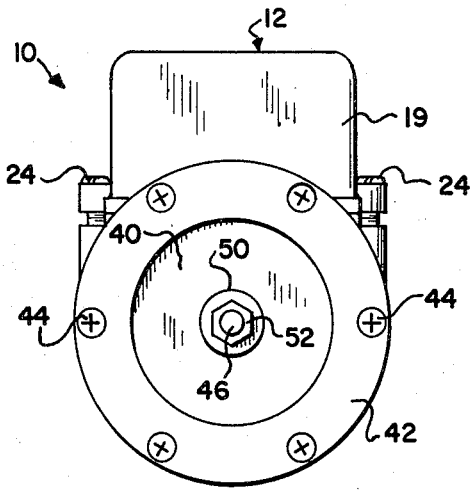
FIG. 2 is an enlarged front elevational view of the switch of FIG. 1 in an assembled state.

Referring now to the drawings, and in particular FIG. 1, the present invention comprises a switch 10, having an air and watertight housing 12. The housing 12 includes a lower housing portion 14 and a housing frame 16 attached thereto by screws 17. A switch mechanism 18 is mounted to the lower side of the frame 16 such that the mechanism 18 is fitted within the lower housing portion 14. An upper housing portion 19 is attached to the lower housing portion 14 by screws 24 such that the upper portion 19 covers and can be sealed to the upper side of the frame 16.

The lower housing poriton 14 has two horizontal grooves 26, one each defined on an inner surface of opposite lateral sides of the lower portion 14. Contained within the lower housing portion 24 is a slidably mounted actuator 30, having a front wall 31 and two side walls 32 attached thereto. The actuator 30 is installed within the lower housing portion 14 through an opening 33 defined in a front side thereof. A lug 34 is attached to the outer surface of each actuator side wall 32 such that each lug 34 is fitted within one groove 26 when the actuator 30 is in place within the lower housing poriton 14. Four springs 35 are disposed two each within each groove 26, with one spring 35 being placed on each side of each lug 34. Springs 35, lugs 34 and grooves 26 form a spring return means (FIG. 3) to return actuator 30 to its initial centered position whenever actuator 30 is moved toward or away from the opening 33 of the lower housing portion 14.

The lower housing portion 14 further incorporates an annular mounting ring 36 surrounding the opening 33. Concentrically fitted within the mounting ring 36 is an inner retaining ring 37 having two projections 38 attached to a side thereof. Projections 38 are fitted one each within each groove 36, thereby holding springs 35 in place. A flexible diaphragm 40 having a center hole 41 is placed over the mounting ring 36 and the opening 31, and is secured and sealed to the mounting ring 36 by an outer retaining ring 42. The outer retaining ring 42 is attached to the mounting ring 36 by screws 44.

Mounted to the outer surface of the actuator front wall 31 is a knob mounting screw 46, which passes through hole 41 defined at the center of diaphragm 40. Hole 41 is sealed by a washer 50 placed on the knob mounting screw 46. Washer 50 is secured and diaphragm 40 is attached to the front wall 31 of actuator 30 by a nut 52. attached to the knob mounting screw 46.

Figure 3:
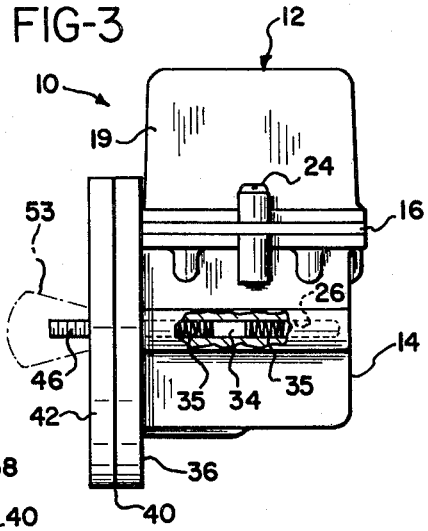
FIG. 3 is a side elevational view of the switch of FIG. 2, with a portion of the housing cut away to show the spring return means for centering the actuator therein.

The flexible diaphragm 40 is mounted so as to be stationary at its edge with respect to the housing 12, whereas the center of diaphragm 40 moves inwardly or outwardly with actuator 30 whenever actuator 30 is moved. Opening 33 in the lower housing portion 14 is thereby sealed. As shown in FIG. 3, a knob 53 is attached to the knob mounting screw 46 and is adapted to be gripped for manually moving the actuator.

Figure 4:
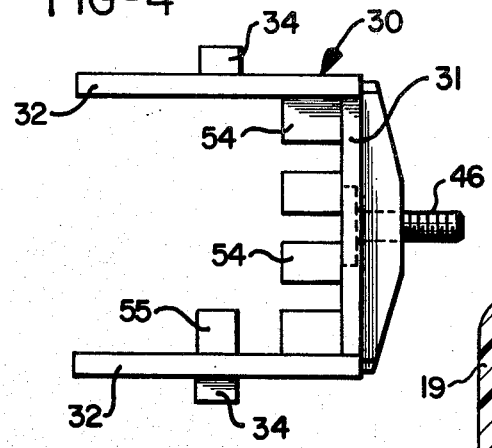
FIG. 4 is a top plan view of the actuator of the switch.

Referring to FIG. 4, the actuator 30, shown in top view, has four projections 54 attached to the front wall 31 at the bottom edge thereof and extending inwardly therefrom. As will be explained in detail, projections 54 are used to free any contact blades which may tack together. A control projection 55 having an instrumental role in the operation of the switch 10, is attached to one side wall 32 at substantially the midpoint of the bottom edge thereof and extends inwardly therefrom.

The Switch Mechanism

Figure 5:
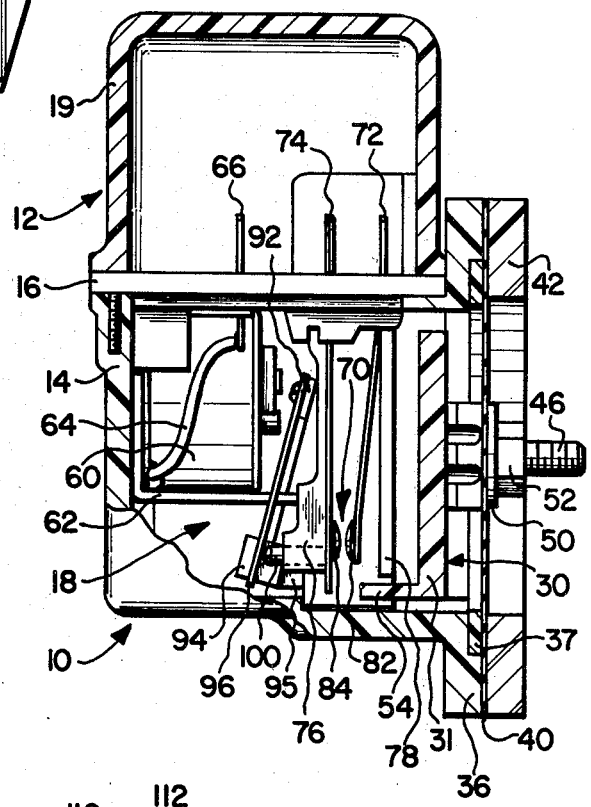
FIG. 5 is an enlarged side elevational view of the opposite side of the switch from that of FIG. 3, showing the switch with a portion of the housing and actuator cut away to show the switch mechanism contained therein.

The switch mechanism 18 of the assembled switch 10, shown in detail in FIG. 5, includes an electromagnetic coil 60 mounted to a supporting member 62 which is attached to the housing frame 16. Wires 64 connect the coil 60 with terminal contacts 66, the latter being mounted in the frame 16. The switch mechanism 18 also includes a pair 70 of normally-open spring contact blades 72 and 74 mounted to the frame 16 and extending downwardly therefrom. Wall portions 76 and 78, constructed of an insulating material, are also mounted to the frame 16 and extend downwardly therefrom so as to isolate the pair of contacts 70. Attached to blade 72 is contact pad 82 at substantially the lower end thereof. Blade 74 is disposed against wall portion 76 when the pair of contacts 70 is in an open state, and is of greater length than blade 72. Blade 74 further has a contact pad 84 attached at a point such that when the pair of contact 70 is closed, pad 84 is in contact with pad 82.

Supporting member 62 is further attached to wall portion 76. Pivotally mounted to supporting member 62 between the electromagnetic coil 60 and the wall portion 76 is an armature 90.

Figure 6:
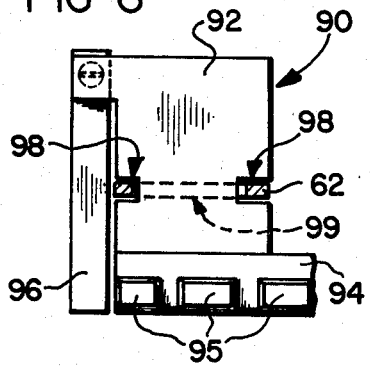
FIG. 6 is a front elevational view of the armature of the switch.

The armature 90, as illustrated in FIG. 6, has a body portion 92, and an end member 94 attached thereto. The end member 94 is constructed of an insulating material and further has three projections 95, all extending in the same direction substantially perpendicularly from the body portion 92. A flexible blade member 96 is fixedly attached at one end thereof to the end of the body portion 92 opposite the end member 94. The blade member 96 further extends in parallel to and along the entire length of one side of the body portion 92.

Two notches 98 are defined within the body portion 92 on opposite sides thereof. A rectangular slot 99 is defined laterally within the supporting member 62 between the electromagnetic coil 60 and wall portion 76, such that the armature 90 is fitted into the slot 99. Notches 98 and slot 99 cooperate so as to form a pivotal mounting for the armature 90 to the supporting member 62.

Referring back to FIG. 5, a pin 100, constructured of an insulating material, is slidably mounted through wall portion 76. One end of pin 100 contacts the rear side of blade 74 and the opposite end of pin 100 contacts the front side of blade 96.

Figure 7:
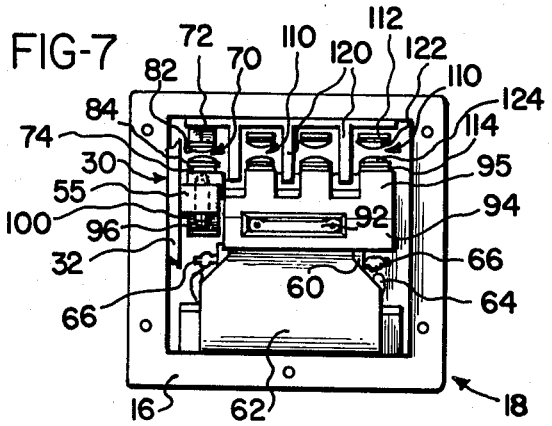
FIG. 7 is a bottom plan view of the housing frame and switch mechanism of the switch, showing also a portion of the actuator.

Referring now to FIG. 7, the switch mechanism 18 also includes additional pairs 110 of normally-open spring contact blades 112 and 114 mounted to the frame 16 and extending downwardly therefrom. The pairs of contacts 110 are disposed between wall portions 76 and 78, with blades 114 disposed against wall portion 76 when pairs of contacts 110 are in an open state. Each of pairs of contacts 110 and 70 are isolated from each other by wall portions 120 constructed of an insulating material and extending between wall portions 76 and 78. Attached to blades 112 are contact pads 122 at substantially the lower ends thereof. Blades 114 are of greater length than blades 112, and further have contact pads 124 attached to each at a point such that when the pairs of contacts 110 are closed, pads 124 are in contact with pads 122.

As further illustrated in FIG. 7, projection 55 is disposed between blade 74 and blade 96.

Operation of the Invention

Figure 8A:
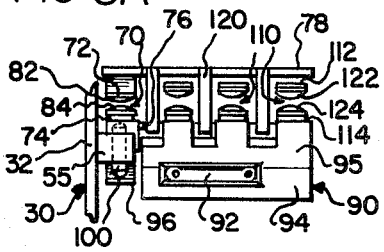
FIGS. 8A–8E show a partial bottom view of the switch mechanism and actuator, depicting the operational sequence of the switch.

When the switch 10 is in a deactivated state, as shown in FIG. 8A, the actuator 30 is in its initial centered position. Pairs of contacts 70 and 110 are in an open position.

Figure 8B:
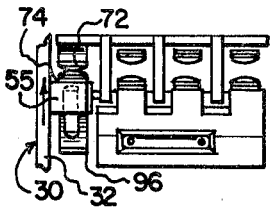
Figure 9A:
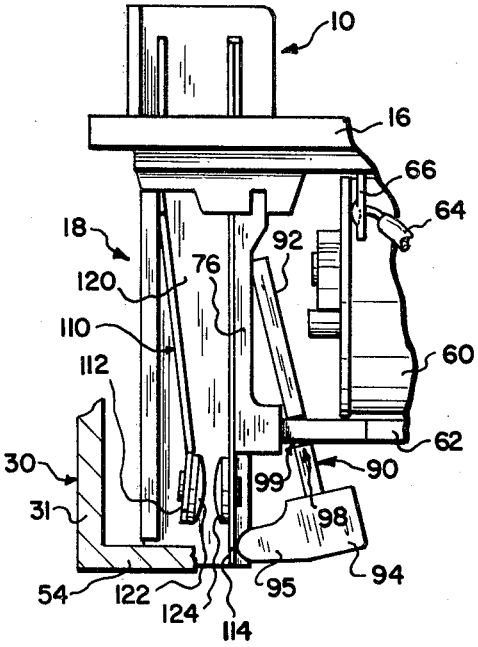
FIGS. 9A and 9B are partial enlarged side views of the housing frame and switch mechanism of the switch from a side opposite to that of FIG. 5, showing the relationship between the armature, a pair of contact blades, the actuator and a projection when the switch is in a deactivated and an activated state.
Figure 9B:
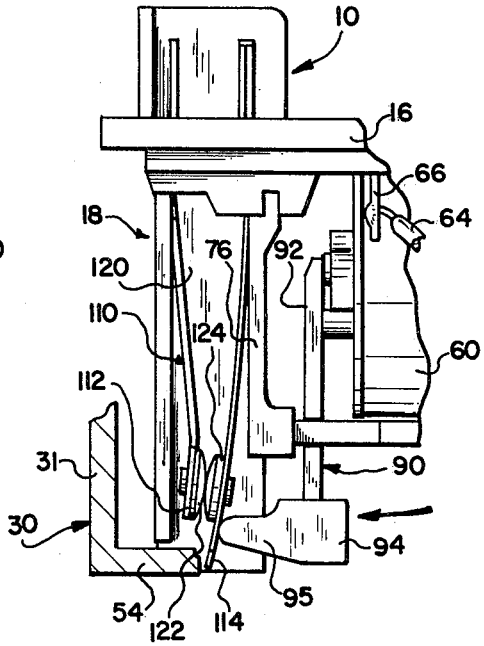

To activate the switch 10, the operator pulls the knob 53 (FIG. 3), moving the actuator 30 (FIG. 1) in an outward direction. As shown in FIG. 8B, projection 55, attached to side wall 32 of the actuator 30, is thereby moved into contact with and pushes against the rear side of blade 74. Blade 74 is moved into contact with blade 72, closing the pair of contacts 70 and energizing the electromagnetic coil 60 (FIG. 5). Energization of the coil 60 causes the armature 90 to rotate about the pivotal mounting formed by notches 98 and slot 99 (FIGS. 9A and 9B).

Figure 8C:
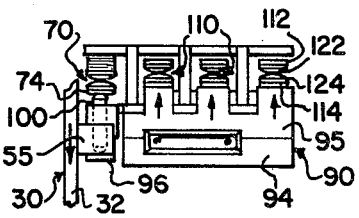

Referring now to FIG. 8C, movement of armature 90 causes projections 95 to push against the rear sides of blades 114, moving blades 114 into contact with blades 112, closing pairs of contacts 110. At the same time, rotation of the armature 90 causes blade 96 to move and push against pin 100. Pin 100 in turn pushes against the rear side of blade 74, holding the pair of contacts 70 closed, and maintaining the coil 60 in an energized state. The switch 10 is thereby placed in an activated state.

When the knob 53 is released by the operator, the spring return means comprised of grooves 26, lugs 34 and springs 35 (FIG. 1) acts to return the actuator 30 to its initial centered position. Projection 55, as also shown in FIG. 8C, is thereby returned to its initial position.

Figure 8D:
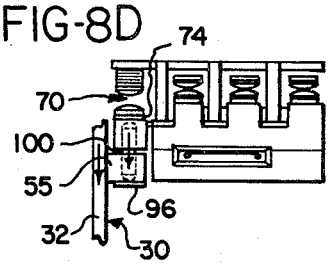

To deactivate the switch 10, the operator pushes knob 53, moving the actuator 30 in an inward direction. As shown in FIG. 8D, projection 55, attached to side wall 36 of the actuator 30, pushes against and moves blade 96 away from pin 100. Blade 96 thereby releases pin 100 which allows the pair of contacts 70 to open, and deenergizes the electromagnetic coil 60. Blade 74 thus returns to its initial position, and consequently pushes against and returns pin 100 to its initial position.

Figure 8E:
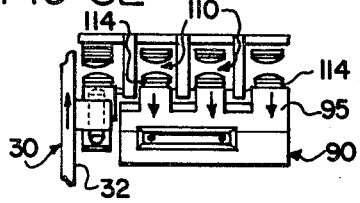

When the coil 60 is deenergized, the armature 90 is released. Projections 95 in turn release blades 114, thereby allowing pairs of contacts 110 to open. As shown in FIG. 8E, when blades 114 return to their open position, the blades 114 push against projections 95, thereby returning armature 90 to its initial position. The switch 10 is thereby placed in a deactivated state.

When the knob 53 is released by the operator, the spring return means comprised of grooves 26, lugs 34 and springs 35 acts to return actuator 30 to its initial centered position. Projection 55, as also shown in FIG. 8E, is thereby returned to its initial position.

It will be recalled that projections 54 (FIG. 4) are for use whenever any of the pairs of contacts 110 and 70 tack together. As can be seen from FIGS. 9A and 9B, whenever the operator initiates deactivation of the switch 10 by pushing the knob 53 (FIG. 3), the front wall 31 of the actuator 30 is thereby moved towards the switch mechanism 18. At substantially the same time that projection 55 has moved blade 96 a sufficient distance so as to allow pair of contacts 70 to open and deenergize the electromagnetic coil 60 (FIG. 8D), projections 54 will engage the ends of the front sides of any of blades 114 or blade 74 which may have tacked to blades 112 or blade 72 respectively. Further movement of actuator 30 and thus projections 54 will cause the projections 54 to push blades 114 and 74 away from blades 112 and 72 respectively, detacking and allowing pairs of contacts 110 or 70 to open.

While the form of apparatus herein described constitutes a preferred embodiment of this invention, it is to be understood that the invention is not limited to this precise form of apparatus, and that changes may be made therein without departing from the scope of the invention which is defined on the appended claims.

What is claimed is:

1. A contactor type electrical switch comprising at least one pair of normally open primary contacts, a pair of normally open control contacts, an electromagnet actuator having a coil and a movable armature influenced by an electromagnetic field created by current flowing through said coil, means on said armature engagable with one of each of said pairs of contacts to close said one contact against the other contact of the pair, circuit means connecting said control contacts to said coil and adapted to control supply of power to said coil, and a reciprocable manually operable actuator engagable with one control contact of said pair thereof to close and open said control contacts independently of said electromagnetic actuator and thereby to control said circuit means.

2. A switch as defined in claim 1, wherein said manually operable actuator is engagable with one primary contact of each of said pairs thereof to open said primary contacts manually if deenergizing said coil does not result in opening of said primary contacts.

3. A switch as defined in claims 1 or 2, including means biasing said manually operable actuator to a neutral position wherein none of said contacts are engaged.

4. A switch as defined in claims 1 or 2 wherein said manually operable actuator includes a pair of spaced control abutments reciprocable together and embracing said one control contact in the normally open position whereby movement of said control abutments will close and open said control contacts for energizing and deenergizing said coil.

5. A switch as defined in claim 4, wherein said manually operable actuator also includes a further abutment reciprocable with said control abutments and arranged to engage and open said one primary contact of each pair thereof after opening of said control contacts in the event that deenergizing said coil does not result in opening of said primary contacts.

6. A contactor type switch of the kind used to control a large electrical load, comprising a housing having front, rear, side, bottom and top walls arranged to complete a hermetically sealed enclosure, one of said walls having a flexible part to transmit reciprocable motion, an actuator located within said housing and attached to said flexible part to move therewith, said actuator being confined by said housing to movement along a predetermined path, a switch unit attached to another of said walls and extending into said enclosure transversely to the path of said actuator, at least one pair of primary contacts and a pair of control contacts mounted in spaced relation on said switch unit, each pair of primary and control contacts having one contact provided with an actuating arm adapted to engage with said actuator to open each pair and to close the pair of control contacts, terminals connected to said contacts and extending to the exterior of said switch unit outside said enclosure providing circuit connectors to said pairs of contacts, an armature movably supported on said switch unit and connected to close said primary contacts and to hold closed said control contacts, a control coil mounted on said switch unit in position to create a field to move said armature in a contact closing direction and spring means acting on said armature in opposition to the field created by said coil, and terminals connected to said coil for connection thereof in a control circuit with said control contacts.

7. A switch for controlling an electric circuit, comprising:

a housing;

an electromagnet mounted within said housing;

a plurality of pairs of contacts mounted in said housing and normally urged open, a first of said pairs being connected in series with said electromagnet so as to energize said electromagnet when said first pair is closed;

an armature mounted on said housing adjacent to said pairs of contacts and controlled by said electromagnet for movement toward said electromagnet causing said armature to push against said pairs of contacts thereby closing said pairs, and for movement away from said electromagnet causing said armature to release said pairs of contacts, thereby allowing said pairs to open;

an actuator movably mounted within the housing; and a projection on said actuator and disposed adjacent said first pair of contacts and said armature such that movement of said actuator in one direction causes said projection to push against and close said first pair, thereby energizing said electromagnet and causing said armature to move toward said electromagnet and close said pairs of contacts, and movement of said actuator in an opposite direction causes said projection to push said armature away from said first pair of contacts thereby allowing said first pair to open and deenergize said electromagnet, releasing said armature and thereby allowing said remaining pairs of contacts to open.

8. A switch as defined in claim 7, wherein said armature is pivotally mounted to said housing at substantially the middle of said armature, with one end of said armature disposed for movement toward and away from said electromagnet and an opposite end of said armature disposed adjacent said pairs of contacts for movement pushing against and releasing said pairs.

9. A switch as defined in claim 7, wherein each said pair of contacts includes two contact blades, each of said blades being mounted at substantially one end thereof to said housing and having an opposite free end, a first blade of each contact pair being of greater length than the second blade such that said free ends of said first blade extend beyond said free end of said second blade, and each said pair of contacts being disposed such that said first blade of each said pair is adjacent said armature so that said armature pushes against said first blade of each said pair of contacts to close said pairs.

10. A switch as defined in claim 9, further comprising additional projections on said actuator, each said additional projection disposed adjacent said free end of said first blades and opposite said armature such that movement of said actuator in said opposite direction causes said projections to push against said first blades to open said pairs of contacts in the event that any contacts fail to open when said armature releases said pairs of blades.

11. A switch for controlling an electric circuit, comprising:

a housing;

an electromagnet mounted within said housing;

a first pair of normally open contact blades mounted in said housing and connected in series with said electromagnet to energize said electromagnet when said first pair is closed;

at least one additional pair of normally open contact blades mounted in said housing;

an armature pivotally mounted to said housing and urged by said pairs of contact blades to an initial open position, said armature including a relatively flat body with a first end and a second end, a contacting member constructed of an insulating material and mounted at said second end of said body adjacent said additional pairs of contact blades, a flexible member fixed to said first end of said body and extending toward said second end along a side of said body, and a sliding member constructed of an insulating material movably mounted to said housing and having an end adjacent said flexible member and an opposite end adjacent said first pair of contact blades, said armature being moved from the initial position toward said electromagnet when said electromagnet is energized causing said contacting member to close said additional pairs of contact blades and causing said flexible member to push said sliding member in a direction to close said first pair of contact blades;

an actuator movably mounted within said housing and having a projection thereon disposed between said first pair of contact blades and said flexible member;

means for moving said actuator in one direction causing said projection to close said first pair of contact blades thereby energizing said electromagnet and moving said armature toward said electromagnet; and means for moving said actuator in an opposite direction causing said projection to move said flexible member away from said first pair of contact blades thereby releasing said sliding member and in turn releasing said first pair to open and deenergize said electromagnet whereby said pairs of contact blades open and return said armature to said initial position.

12. A switch for controlling an electric circuit, comprising:

a housing;

an electromagnet mounted within said housing;

a plurality of pairs of normally open contacts mounted in said housing, a first of said pairs being connected in series with said electromagnet so as to energize said electromagnet when said first pair is closed;

an armature mounted to said housing adjacent to said pairs of contacts and said electromagnet for movement toward said electromagnet whenever said electromagnet is energized which causes said armature to push against said pairs of contacts thereby closing said pairs, and for movement away from said electromagnet whenever said electromagnet is deenergized, which causes said armature to release said pairs of contacts, thereby allowing said pairs to open;

an actuator movably mounted within said housing; and means attached to said actuator to facilitate operating said actuator from outside said housing;

said actuator and operating means being further disposed such that pulling said operating means in an outward direction relative to said housing causes said actuator to push against and close said first pair of contacts, thereby energizing said electromagnet, and pushing said operating means in an inward direction relative to said housing causes said actuator to push said armature away from said first pair of contacts thereby allowing said first pair to open, deenergizing said electromagnet.

13. A switch as defined in claim 12, wherein said operating means consists of a manually operated knob.

14. A switch as defined in claim 12, further comprising means for return of said actuator to an initial starting position following movement of said actuator from said initial position.

15. A switch as defined in claim 14, wherein:

said housing has at least one groove on an inner surface thereof;

said return means includes a lug mounted on said actuator for each said groove, said lugs being disposed so as to be movable within said grooves whenever said actuator is moved, and a plurality of springs, two of said springs being disposed within each said groove on opposite sides of said lug, said springs cooperating with said lugs to return said actuator to said initial position.

16. A switch as defined in claim 12, wherein said housing is constructed so as to fully enclose said electromagnet, said armature, said actuator and said pairs of contacts and protect the same from contact with air and moisture from outside said housing, the latter having a removable portion allowing access to said pairs of contacts, said housing further having means mounted thereto for allowing said operating means to pass through said housing while full enclosure is maintained, thereby allowing operation of said actuator from outside said housing.

* * * * *